US007188941B2

(12) United States Patent
Platt et al.

(10) Patent No.: US 7,188,941 B2
(45) Date of Patent: Mar. 13, 2007

(54) VALVE FOR A PRINTING APPARATUS

(75) Inventors: David P. Platt, Sherwood, OR (US); Edward F. Burress, Wilsonville, OR (US); James M. Bonicatto, Portland, OR (US)

(73) Assignee: Xerox Corporation, Stamford, CT (US)

( * ) Notice: Subject to any disclaimer, the term of this patent is extended or adjusted under 35 U.S.C. 154(b) by 372 days.

(21) Appl. No.: 10/753,112

(22) Filed: Jan. 7, 2004

(65) Prior Publication Data

US 2005/0146573 A1 Jul. 7, 2005

(51) Int. Cl.
*B41J 2/175* (2006.01)

(52) U.S. Cl. ..... 347/87

(58) Field of Classification Search ..... 347/9, 347/20, 40, 44, 47, 87, 93; 137/614.2, 614.21, 137/855, 856; 418/63
See application file for complete search history.

(56) References Cited

U.S. PATENT DOCUMENTS 4,103,686 A * 8/1978 LeFevre ..... 604/249
4,727,378 A * 2/1988 Le et al. ..... 347/35
4,882,596 A * 11/1989 Tsuzuki et al. ..... 347/10
6,139,291 A * 10/2000 Perevozchikov ..... 418/55.1
6,592,346 B2 * 7/2003 Bushnell ..... 418/63

FOREIGN PATENT DOCUMENTS

JP 404187448 A * 7/1992

* cited by examiner

*Primary Examiner*—Anh T. N. Vo
(74) *Attorney, Agent, or Firm*—Fay Sharpe LLP

(57) ABSTRACT

A valve for a printing apparatus that uses liquid ink includes a valve seat, a valve stop and a valve member interposed between the valve seat and the valve stop.

12 Claims, 9 Drawing Sheets

VALVE FOR A PRINTING APPARATUS

BACKGROUND

Ink jet printers create an image on a surface by ejecting ink through orifices in a print head face plate onto a substrate. The print head face plate communicates with a print head reservoir, which communicates with an ink source. Solid ink printers melt solid ink and deliver the melted ink to the print head reservoir.

When the solid ink printer is turned off, the ink that remains in the print head reservoir can freeze. When the ink thaws in the print head reservoir, air that was once in solution in the ink can come out of solution to form air bubbles or air pockets in the print head reservoir. Air pockets can impede the filtering of the ink as it travels toward the orifices in the print head face plate. Air pockets can also impair the print quality of the printer when an air bubble, as opposed to ink, is delivered through the orifice resulting in an unintended blank spot on the print media. Accordingly, it is desirable to purge periodically the cavities and channels in the print head reservoir to increase print quality.

It is known to purge air out of solid ink print heads using a vacuum system, but a vacuum system is costly, time consuming and less efficient than a system that uses positive pressure. Furthermore, it is desirable to wipe the jets during purging, which is not possible when using a vacuum system. Accordingly, a positive pressure purge system is desirable. In a positive pressure purge system it is desirable to provide a valve to allow purging air out of the orifices and to inhibit forcing ink back out of the cavity where the ink is loaded into the print head.

BRIEF DESCRIPTION

A valve for a printing apparatus that uses liquid ink includes a valve seat, a valve stop and a valve member interposed between the valve seat and the valve stop. The valve stop is positioned downstream from the valve seat and includes a contact surface that retains the valve member.

DETAILED DESCRIPTION

Figure 10:
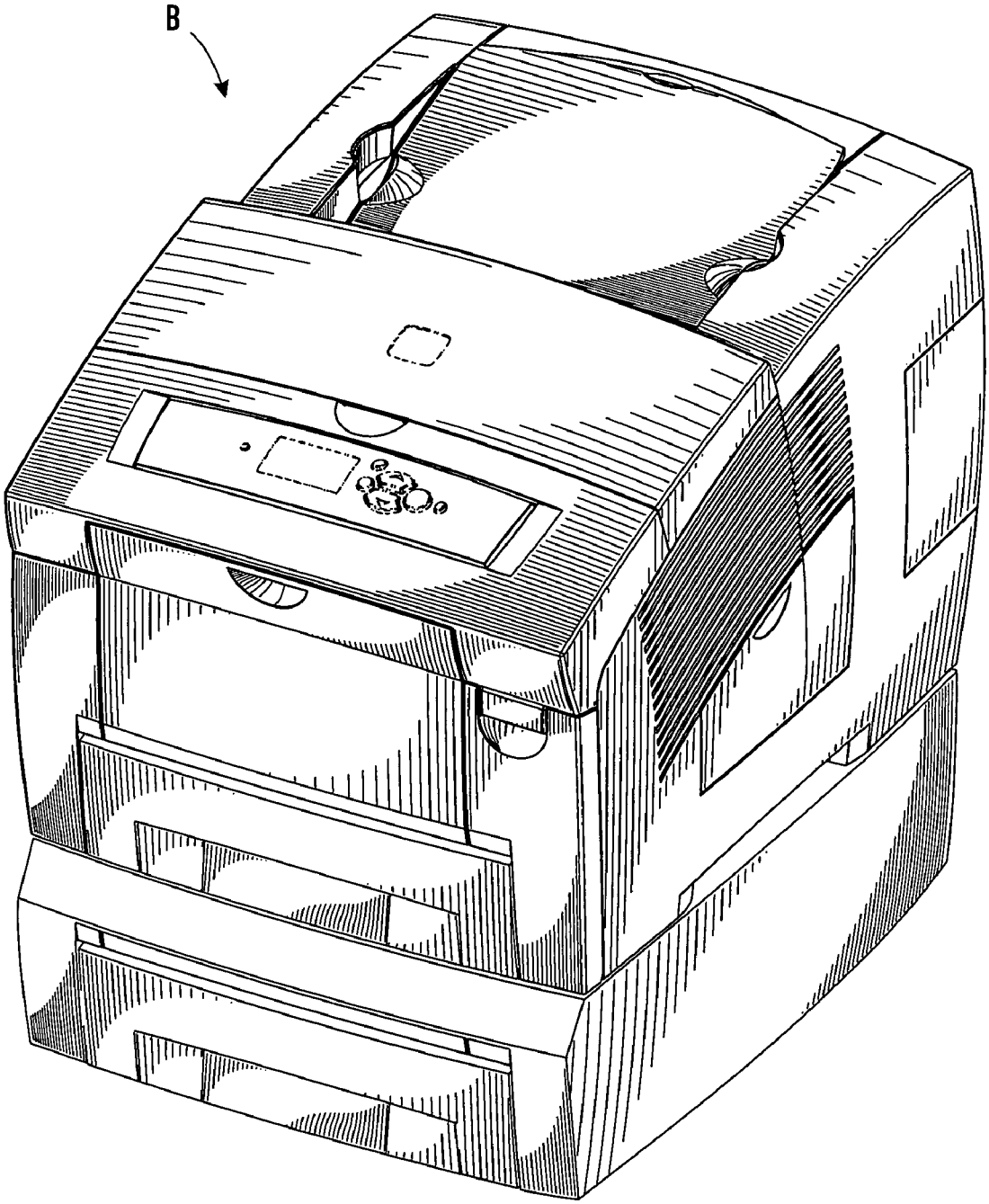
FIG. 10 is a perspective view of an ink jet printer that can contain the print head reservoir of FIG. 1.
Figure 11:
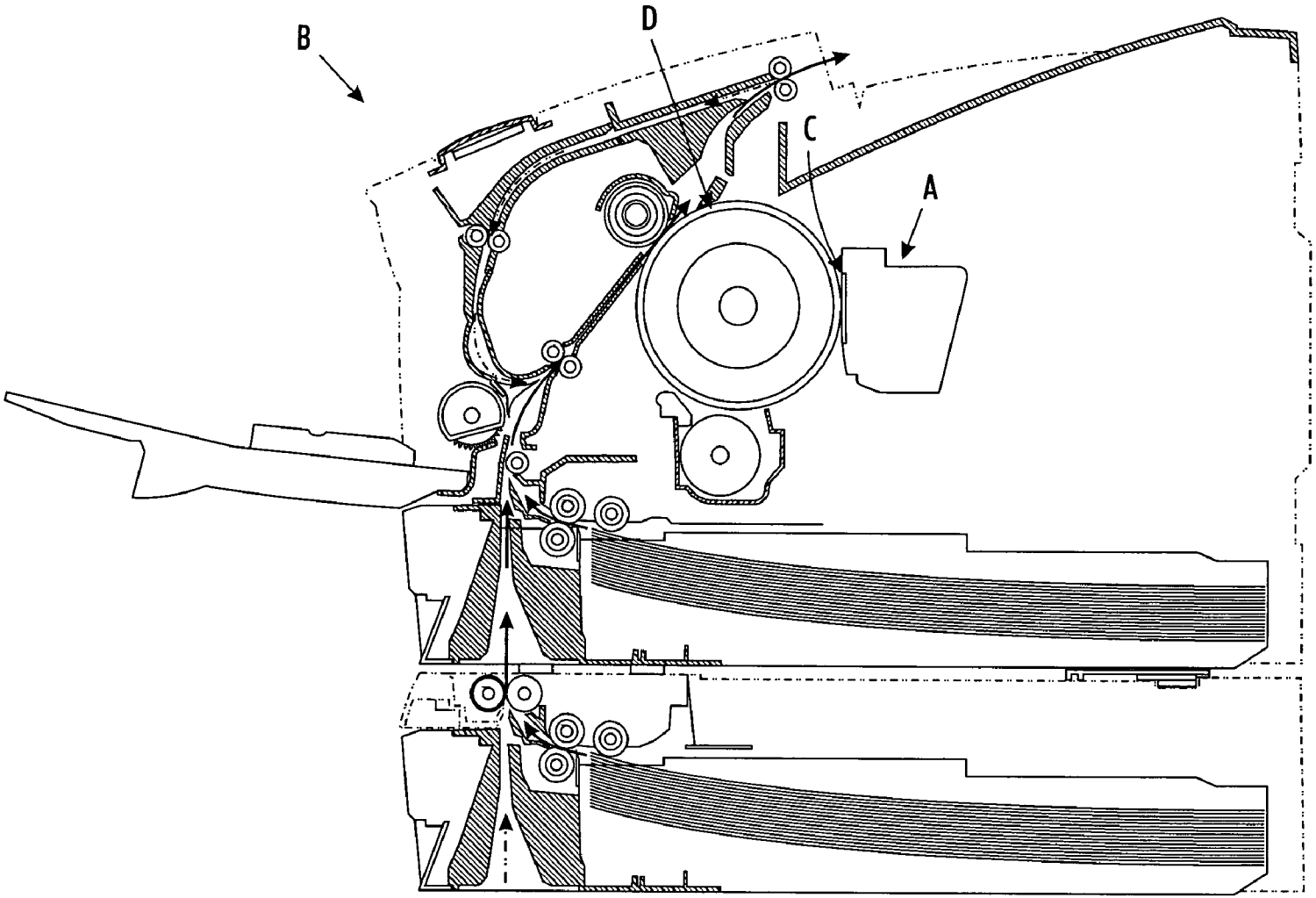
FIG. 11 is a side cross-sectional view of the ink jet printer of FIG. 10.

Referring to FIGS. 10 and 11, a print head A for an ink jet printer B generally delivers liquid ink to a jet stack C that transfers the ink onto a drum D. The print media, which can include paper, travels around the drum and picks up the ink deposited on the drum. Air can get into the pathway of the ink as it travels through the print head. To remove the air from the pathway, the print head is purged, which will be described in more detail below.

Figure 1:
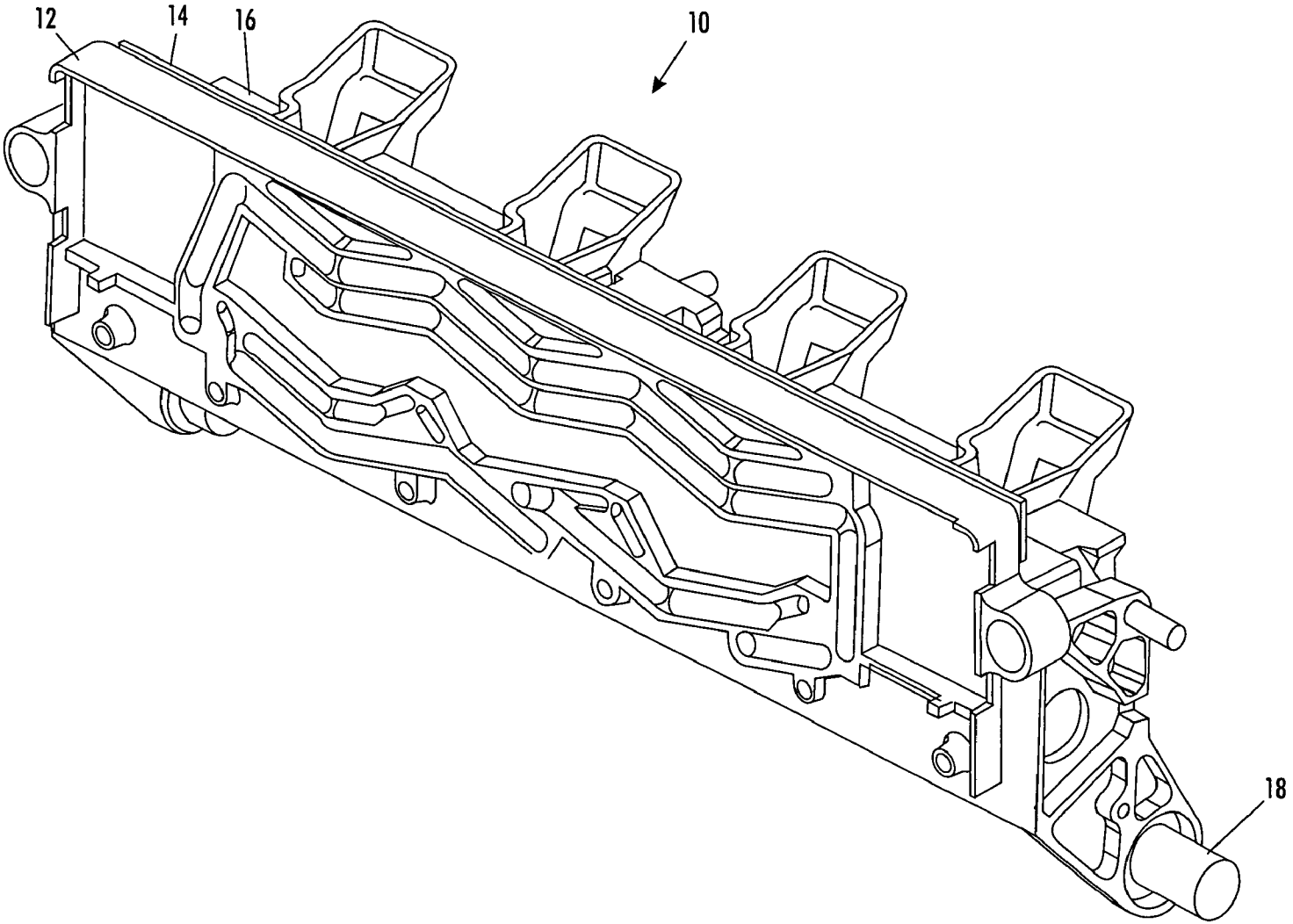
FIG. 1 is a front perspective view of a portion of a print head reservoir for an ink jet printer.

With reference to FIG. 1, a print head reservoir 10 includes a first or front plate 12, a second or middle plate 14 and a third or rear plate 16. The print head reservoir 10 is a portion of the print head and is situated inside the ink jet printer such that the bottom of each plate is substantially horizontal and the reservoir can rotate about a pair of journals 18 (only one visible in FIG. 1). The terms "front," "middle," and "rear" are used for ease of understanding to describe the components of the reservoir as they are shown in the figures; the terms are not used to limit the position of components in relation to one another.

Figure 2:
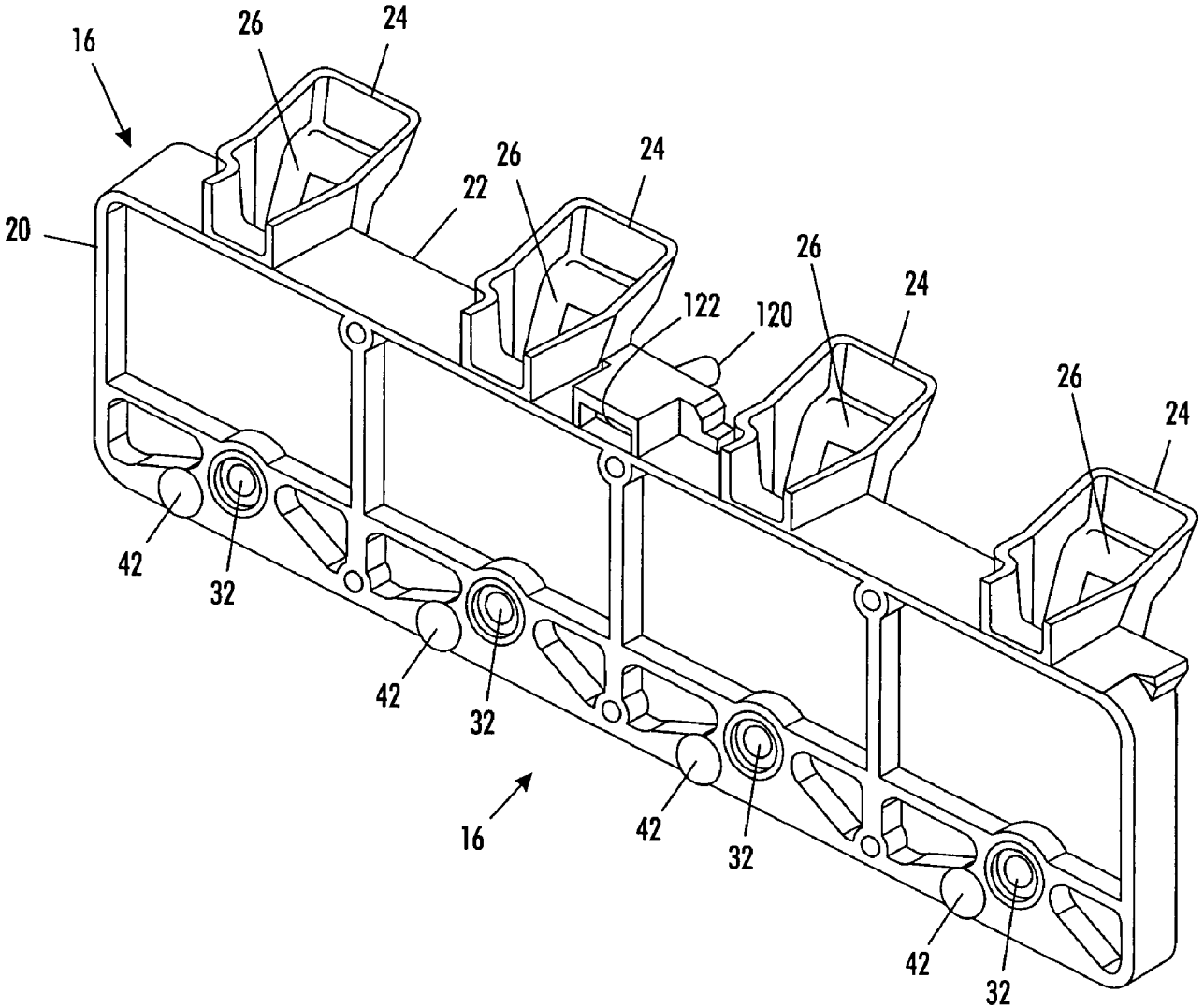
FIG. 2 is a front perspective view of a rear plate of the print head reservoir of FIG. 1.

Generally, the ink travels from the rear plate 16 towards the front plate 12. With reference to FIG. 2, the rear plate includes a front side 20 that is adjacent the middle plate 14 when the reservoir is assembled and a rear side 22 opposite the front side. A plurality of bucket walls 24 extend from the rear side 22 to define a plurality of ink buckets 26. In the embodiment depicted, four ink buckets are shown and each bucket receives a different color ink, particularly yellow, cyan, magenta and black; however, a fewer or greater number of ink buckets can be provided and the ink buckets can receive different colors of ink. The ink buckets 26 usually receive ink that has been melted and dripped into the buckets; however, liquid ink that has not been melted can also be delivered to the ink buckets.

Figure 3:
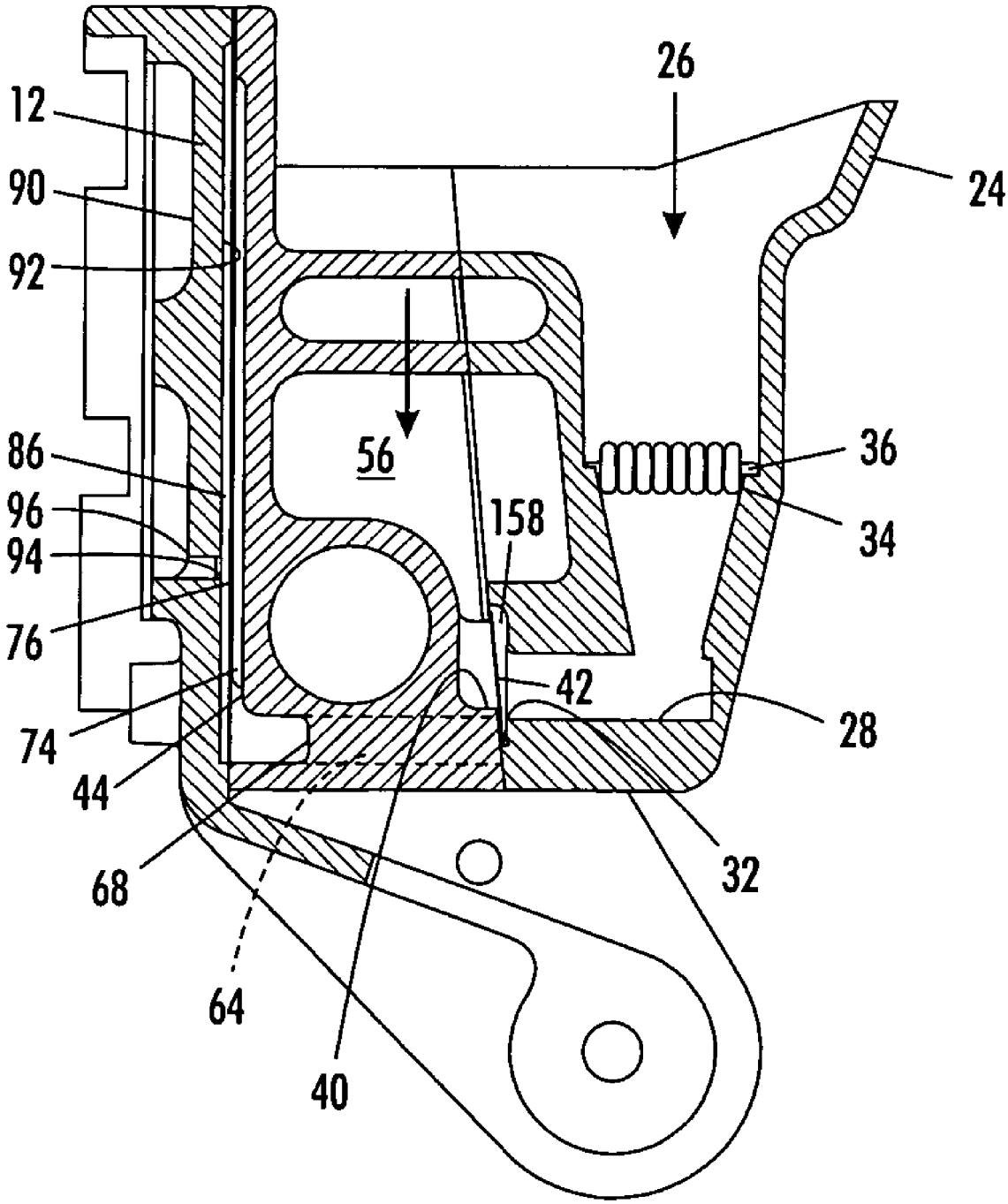
FIG. 3 is a view of a side cross-section of the print head reservoir of FIG. 1.

With reference to FIG. 3, each ink bucket 26 communicates with a passage 28 which communicates with a rear plate outlet 32. A filter 34 is disposed in each ink bucket on a shoulder 36 that projects inwardly from the bucket wall 24 into the ink bucket 26. The filter 34 removes impurities in the ink before the ink travels into the passage 28 and towards the rear plate outlet 32. The rear plate outlet 32 communicates with a middle plate inlet 40 through a valve member 42. The valve member 42 comprises a component of a one-way check valve that allows ink to pass from the rear plate outlet 32 into the middle plate inlet 40. The valve member 42 precludes ink from passing from the middle plate inlet 40 back into the rear plate outlet 32 during purging of the ink path downstream of the valve. The valve member 42 opens and closes in response to a pressure differential between the rear plate outlet 32 and the middle plate inlet 40. Further description of the valve will be provided after further description of the path of the ink through the print head reservoir.

Figure 4:
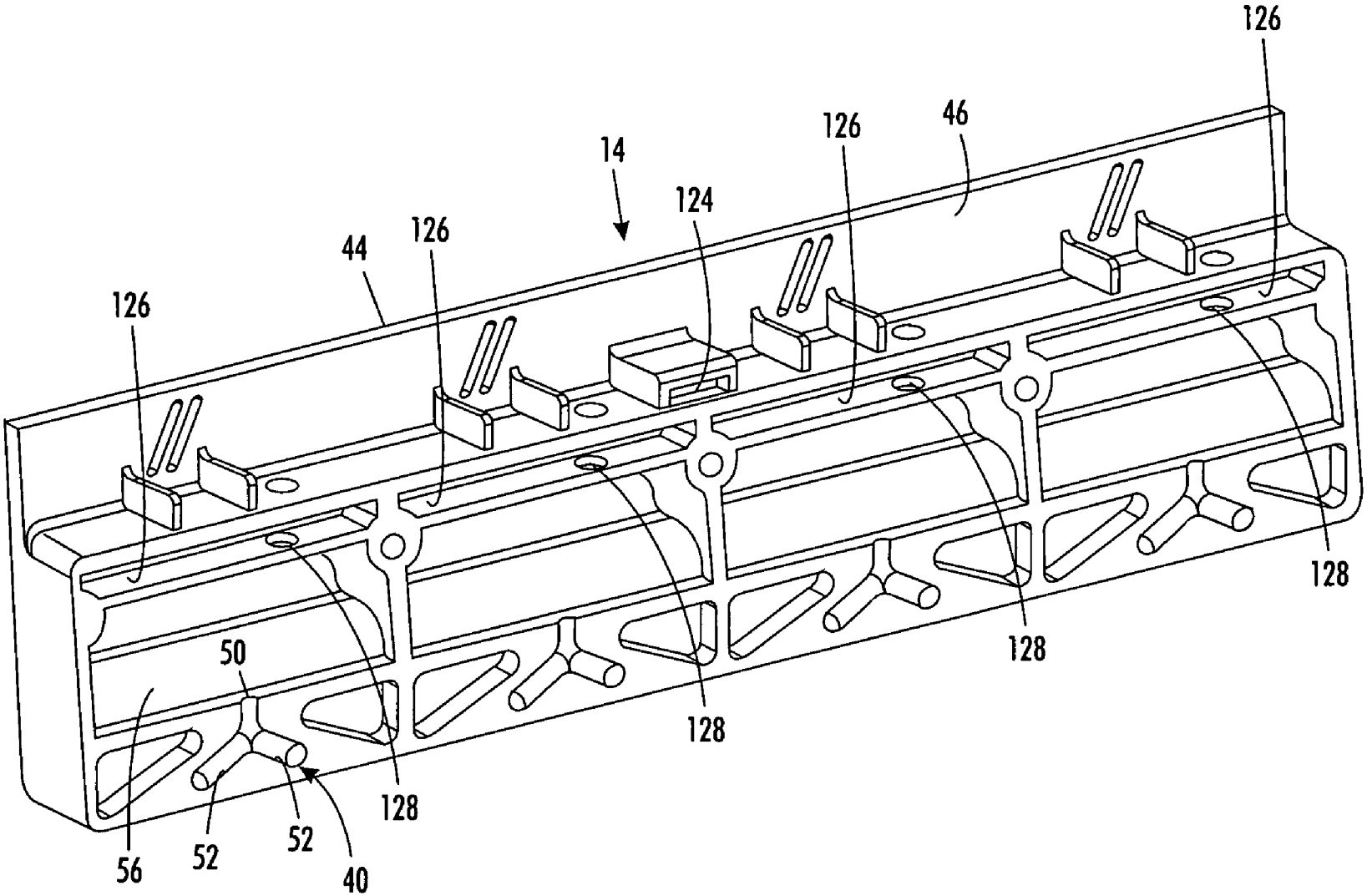
FIG. 4 is a rear perspective view of a middle plate of the print head reservoir of FIG. 1.

Referring to FIG. 4, the middle plate 14 includes a front side 44 and a rear side 46. The front side 44 of the middle plate abuts the front plate 12 and the rear side 46 of the middle plate abuts the front side 20 of the rear plate 16. The middle plate inlet 40 includes three lobed depressions situated 120 degrees apart from one another formed in the rear side 46 of the middle plate 16. Two lobes 52 depend generally downward and the third lobe 50 extends upward to communicate with an ink chamber 56. Ink flows from the ink bucket 26 into the middle plate inlet 40 and into the ink chamber 56 through the upward lobe 50. The ink chamber 56 is defined as a depression in both the rear side 46 of the middle plate 14 and the front side 20 of the rear plate 16, as seen in FIG. 3.

Ink exits the ink chamber 56 through openings 58 (FIG. 5) in the downward lobes 52. Each downward depending lobe 52 includes an opening 58 that communicates with a passage 64 (only one shown in phantom in FIG. 3) which communicates with a middle plate outlet 68 on the front side 44 of the middle plate 14. In the embodiment depicted, eight middle plate outlets 68 are provided at the bottom of the front side 44 of the middle plate, two for each color of ink. A greater or fewer number of middle plate outlets can be provided. Ink exits the middle plate outlets 68 and enters an upstream filter cavity 74 defined between the front side 44 of the middle plate 14 and the filter 76.

Since the size of the orifices in the jet stack is so small, the ink is filtered prior to delivery to the ink stack. A vertical filter 76 is sandwiched between and situated substantially parallel to the front plate 12 and the middle plate 14. Ink flows through the filter 76 from the upstream filter cavity 74 into a downstream filter cavity 86.

The front plate 12 includes a front side 90 and a rear side 92 which is adjacent the filter 76. The downstream filter cavity 86 is defined between the filter 76 and the rear side 92 of the front plate 12. The front plate 12 includes a plurality of openings 94 (only one shown in FIG. 3) on the rear side 92 that communicate through passages with a plurality of front plate outlets 96 on the front side 90 of the front plate. Ink flows through the filter 76 and into the openings 94.

Ink flows from the ink buckets 26 towards the front side 90 of the front plate 12 and then on to a jet stack, which is not shown. More description of the front plate is provided in co-pending patent application entitled "Purgeable Print Head Reservoir," which is assigned to the assignee of this application, filed on the same date as this application, and is incorporated by reference herein. Ink that flows through the print head reservoir can freeze when the printer is turned off. Air bubbles can form in the filter cavities 74 and 86 from freeze-thaw cycles when air comes out of the ink solution or from improper ink filling. Trapped air on the upstream side of the filter, i.e. in the upstream ink cavity 74, reduces the effective size of the filter 76. Trapped air on the downstream side, i.e. in the downstream filter cavity 86, can dump bubbles into the flow path during printing which can require additional purges of the ink flow path. Purge vents (not shown) are provided to bleed any trapped air in the filter cavities 74 and 86. These vents are more particularly described in co-pending patent application entitled "Print Head Reservoir Having Purge Vents," which is assigned to the assignee of this application, filed on the same date as this application, and is incorporated by reference herein. Air can also form in channels leading from the upstream ink cavity 86 toward the ink stack. If these channels are not purged, air instead of ink can be delivered to the ink drum which can affect the print quality. Also, air bubbles can block the orifices in the ink stack.

To purge the filter cavities 74 and 86 and the channels leading to the print stack, pressure is introduced into the print head reservoir. With reference back to FIG. 2, a fitting 120 attaches to the rear side 22 of the rear plate 16. The fitting 120 connects to an air pressure source (not shown). In an alternative embodiment, fluid pressure can be applied elsewhere on the print head and a fluid other than air, such as ink, can be used to apply the fluid pressure to purge the print head reservoir. The fitting communicates with a rear plate passage 122 which communicates with a middle plate passage 124 (FIG. 4). The middle plate passage 124 communicates with a four air plenums 126, one for each color. Each of the plenums 126 includes an opening 128 that leads a respective ink chamber 56. The upper opening aligned with and across from the opening 128 can be covered.

During a purge cycle, air passes through the fitting 120 into the plenums 126 via the passages 122 and 124. From the plenums 126 air travels through the openings 128 into the ink cavities 56. The air pressure in the ink cavities results in a greater pressure on the downstream side of the valve member 42 (FIG. 3), thus closing the valve. The air pressure forces ink through the middle plate outlets 68 forcing any air pockets found in the filter cavities 74 and 86 out the vents. The air pressure forces air out of the channels leading to the jet stack. After the ink is forced out of the jet stack, the jet stack can be wiped clean.

Figure 6:
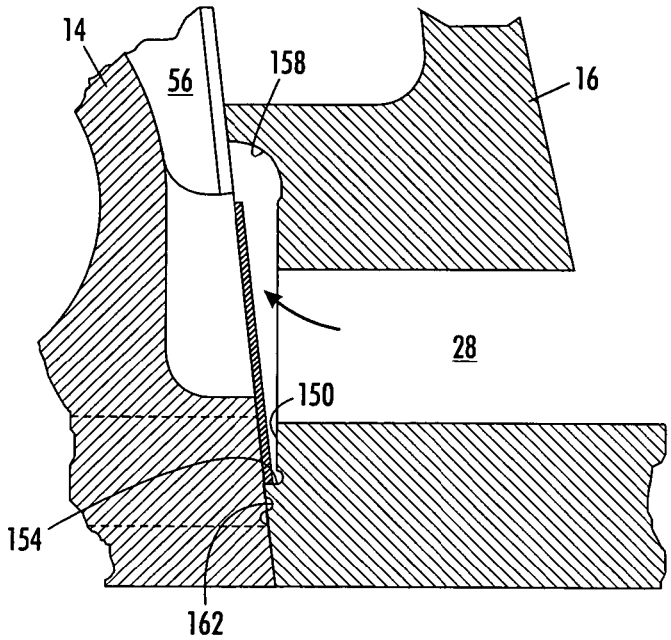
FIG. 6 is close up view of a lower cross section of the print head reservoir as shown in FIG. 3 showing the valve in an open position.
Figure 7:
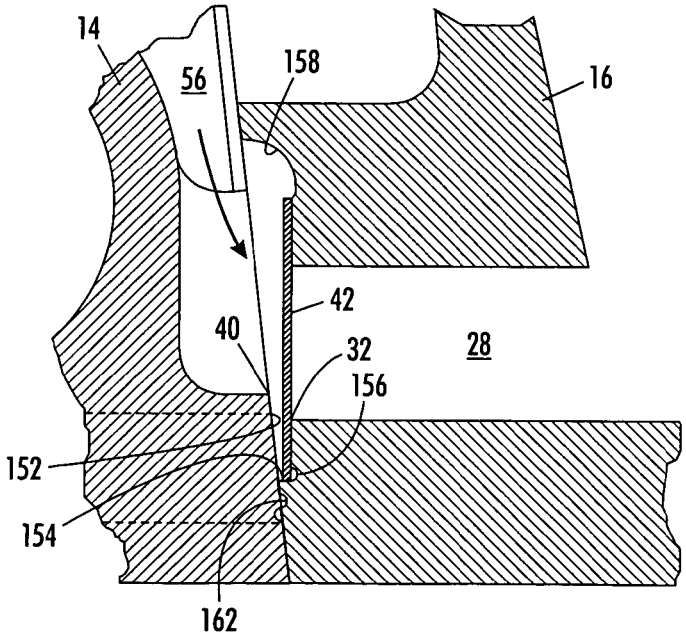
FIG. 7 is a close up view of a lower cross section of the print head reservoir as shown in FIG. 3 showing the valve in a closed position.

With reference to FIGS. 6 and 7, the valve member 42 is situated between the middle plate 14 and the rear plate 16. More particularly, the valve is positioned between a valve seat 150 (FIG. 6), which defines the rear plate outlet 32, and a valve stop 152 (FIG. 7), which defines the middle plate inlet 40. The valve seat 150 is substantially vertical and flat, and the valve stop 152 is disposed at an angle to the valve seat 150. In one embodiment, the angle between the valve seat 150 and the valve stop 152 is five degrees; however, in an alternative embodiment the angle can change.

The valve member 42 can be a flat full hard stainless steel disc made from a precision stamping die. Such a configuration results in little or no burrs around the periphery of the valve member, which could affect the valve member's ability to close the rear plate outlet 42 during purging. Nevertheless, the valve member can be made from other materials. The valve member 42 can be made from any material that will provide an adequate seal and be able to maintain the seal in the ink environment while not contaminating the ink. Furthermore, the valve member 42 can take other configurations such a ball.

Figure 8:
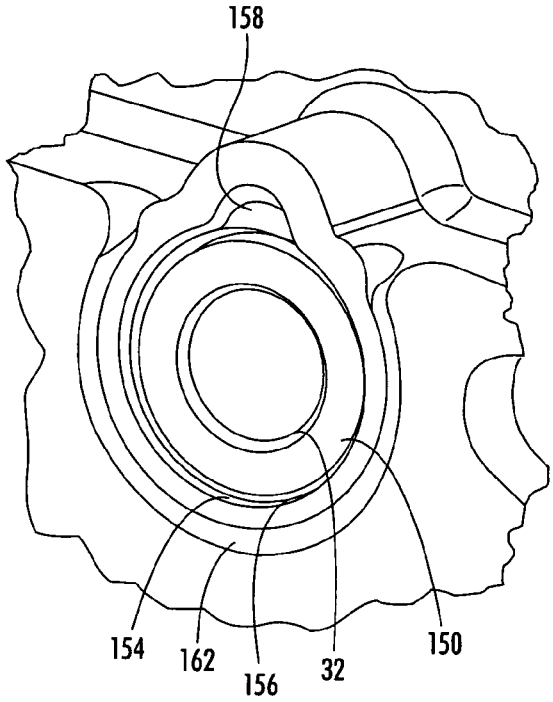
FIG. 8 is a close up perspective view of a valve seat of the print head reservoir of FIG. 1.

With reference to FIG. 8, the valve seat 150 is sunk into the rear plate 16 so that a ledge 154 surrounds the outer periphery of the valve seat. The valve member 42 freely rests on the ledge 154 so the entire valve member 42 can move laterally between the valve seat 150 and the valve stop 152. As more clearly seen when comparing FIG. 6 to FIG. 7, the valve member both rotates slightly and moves laterally in the exemplary embodiment. The ledge 154 extends underneath the valve seat 150 to define a valve moat 156. The filter 34 disposed in the ink bucket 26 (FIG. 3) removes much of the impurities in the ink before they can reach the valve seat 150. The valve moat 156 precludes small particles in the ink from building up around the periphery of the valve member 42 and on the valve seat 150. The valve moat 156 also accommodates any burrs that exist on the periphery of the valve member 42 so that the valve member 42 can tightly seat against the valve seat 150.

Figure 9:
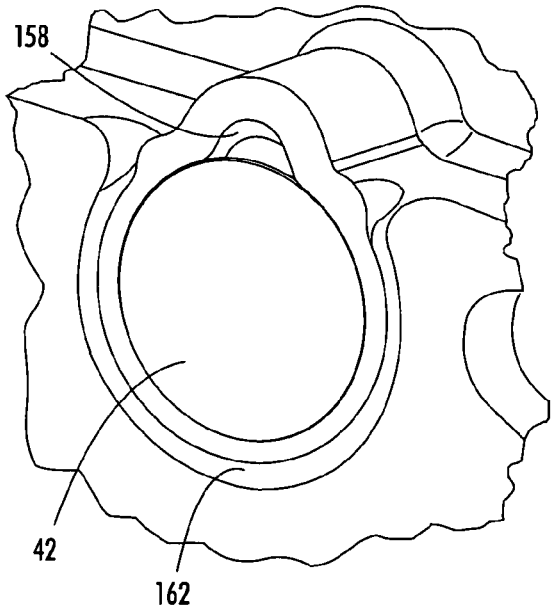
FIG. 9 is a close up perspective view similar to FIG. 8 showing the valve in a closed position.

A relief passage 158 is provided adjacent the rear plate outlet 32 to reduce the flow resistance through the rear plate outlet when the valve member is in an open position. With reference to FIG. 9, the relief passage is situated above the valve member 42. The relief passage 158 is defined by an upper portion of the ledge 152. The relief passage aligns with the ink cavity 56 to promote upward flow of the ink over the valve member 42 into the ink cavity, as seen in FIGS. 6 and 7.

The middle plate 14 and the rear plate 16 can be glued together. A glue stop channel 162 can be provided around the periphery of the ledge 152 to catch any glue attempting to migrate towards the valve seat 150.

Figure 5:
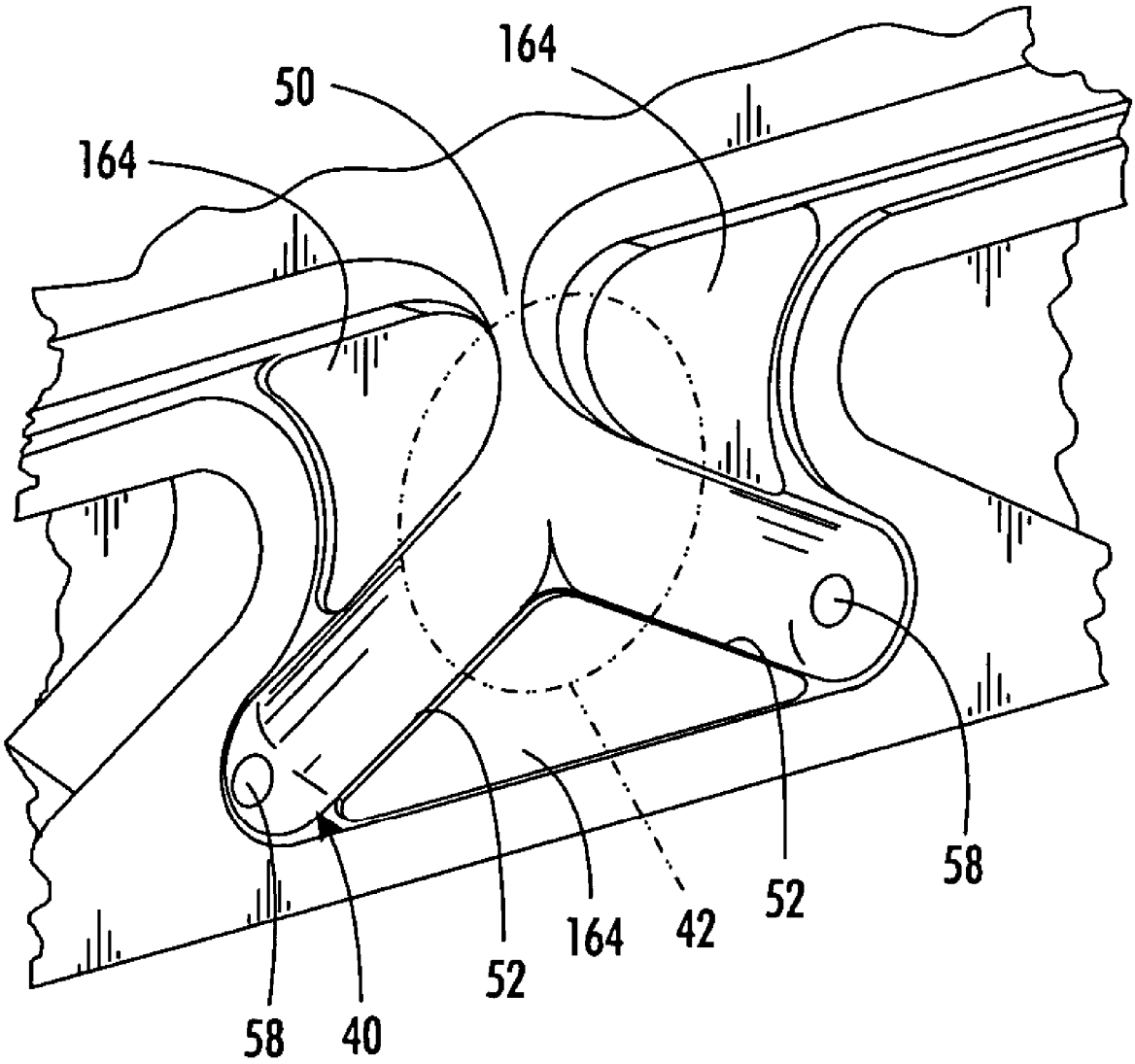
FIG. 5 is a close up view of an inlet of the middle plate of FIG. 4.

The valve stop 152 retains the valve member 42 when in the open position. With reference to FIG. 5, the valve stop 152 includes a contact surface 164 that defines the lobed depressions 50 and 52. The contact surface 164 retains the valve member 42, and the depressions 50 and 52 provide adequate flow and surface area of the valve member exposed to the pressure that is applied during purging.

Since the valve member 42 is disposed substantially vertically between valve seat 150 and the valve stop 152, the instability of the valve member position allows the valve to open at very low pressures. For example, in the exemplary embodiment, the valve can open at pressures below 0.1 inches of water. The head pressure of the ink stored in the ink bucket 26 provides the adequate pressure to open the valve. Nevertheless, the valve can be disposed at other orientations than vertical, such as horizontal or some angle between vertical and horizontal. In such a configuration, the orientation of the valve seat and valve stop may change.

The valve is kept from rotating too much by the valve stop 152 so that the valve can close at low pressures. In the exemplary embodiment, the valve can close at purge pressures below 5 inches of water. The exposed surface area of the valve member 42 because of the depressions 50 and 52, allows a low purge pressure to close the valve. The seal between the valve seat 150 and the valve member 42 need not be air tight, the seal need only prevent ink from ejecting out of the ink bucket 26 during a purge.

The exemplary embodiment has been described with reference to the preferred embodiments. Obviously, modifications and alterations will occur to others upon reading and understanding the preceding detailed description. For example, the valve system was described with particularity to an ink jet printer; however, the valve system is amenable to other environments where a valve needs to open and close in response to small pressure differentials. It is intended that the exemplary embodiment be construed as including all such modifications and alterations insofar as they come within the scope of the appended claims or the equivalents thereof.

The invention claimed is:

1. A print head for an ink jet printer comprising:

a first passage in communication with an ink source;

a surface having an orifice for delivering ink to an associated print media and/or drum, wherein the orifice communicates with the first passage;

a second passage in communication with the first passage and an associated pressure source; and a valve member disposed in the first passage upstream from the second passage, wherein the valve member is adapted to move between an open position and a closed position, when in the open position the valve allows ink to travel towards the orifice and when in the closed position the valve inhibits ink from traveling towards the ink source;

a valve seat and a valve stop positioned downstream from the valve seat, wherein the valve member seats on the valve seat when in the closed position and the valve member abuts the valve stop when in the open position;

wherein the valve stop includes a contact surface downstream from and at an acute angle to the valve seat;

wherein the contact surface defines at least one depression to expose a portion of the valve member to pressure from the associated pressure source when the valve member is in a closed position.

2. The print head of claim 1, wherein the acute angle is about 5 degrees.

3. The print head of claim 1, further comprising a valve moat adjacent a periphery of the valve seat.

4. The print head of claim 1, further comprising a relief passage defined along the passage adjacent the valve member, wherein the relief passage reduces the resistance of flow of ink around the valve member when in the open position.

5. The print head of claim 4, wherein the relief passage is positioned above the valve member.

6. The print head of claim 1, wherein the valve member comprises a substantially vertically disposed plate.

7. A printer including the print head of claim 1.

8. The print head of claim 1, further comprising an ink bucket in communication with the first passage.

9. The print head of claim 1, further comprising a fitting in communication with the associated pressure source.

10. A print head for a printing apparatus that uses liquid ink, the print head comprising:

an ink bucket for storing ink received from an associated ink source, the ink bucket in communication with a passage defined in the print head;

a surface defining an orifice for ejecting ink out of the print head, wherein the orifice is in communication with the passage;

means for applying pressure to the passage separate from ink stored in the ink bucket; and a valve disposed in the passage, wherein the valve opens in response to pressure applied by ink stored in the ink bucket and closes in response to pressure applied by the pressure applying means.

11. The print head of claim 10, wherein the pressure applying means includes a fitting in communication with an air pressure source.

12. The print head of claim 10, wherein the valve includes a disc-shaped plate vertically disposed in the passage.

* * * * *